US006319032B1

(12) United States Patent
Carrel et al.

(10) Patent No.: US 6,319,032 B1
(45) Date of Patent: Nov. 20, 2001

(54) ZERO FORCE INSERTION SOCKET FOR GUN MOUNTS

(75) Inventors: Stephen M. Carrel, Findlay, OH (US); Peter G. Puhak, Canandaugua, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/365,213

(22) Filed: Jul. 30, 1999

(51) Int. Cl.[7] ..... H01R 13/62; H01R 13/625
(52) U.S. Cl. ..... 439/259; 439/342; 439/263
(58) Field of Search ..... 439/660, 259, 439/263, 264, 266, 342

(56) References Cited

U.S. PATENT DOCUMENTS 4,211,458 * 7/1980 Kent ..... 439/267
4,376,562 * 3/1983 Kaley ..... 439/264
4,381,130 * 4/1983 Sprenkle ..... 439/268
4,950,980 * 8/1990 Pfaff ..... 439/296
5,252,098 * 10/1993 Sano et al. ..... 445/5
5,410,257 * 4/1995 Swaffield ..... 324/755
5,833,483 * 11/1998 Lai et al. ..... 439/342
5,855,489 * 1/1999 Walker ..... 439/342

* cited by examiner

*Primary Examiner*—Brian Sircus
*Assistant Examiner*—Chandrika Prasad

(57) ABSTRACT

A zero insertion force socket apparatus is described which includes a body having a socket extending into the body and designed to receive a gun mount assembly. The socket includes a central bore extending through the body and a plurality of electrically conductive, deformable pin holders seated in apertures surrounding the central bore and extending into the body where the holders have an inside diameter greater than a diameter of a pin of a gun mount assembly for zero force insertion and removal. The apparatus also includes a plurality of electrical contacts in electrical communication with the holders and having an exposed end for receiving electric. The apparatus also includes a gap interposed between a top and bottom portion of the apparatus with an engagement member movably fitted within the gap. The engagement member includes a holder engagement surface and a coupling member where the coupling member is designed to change the engagement member from a disengaged state to an engaged state. The disengaged state allows zero force insertion and removal, while the engaged state deforms the holders so that the holders make electrical contact with the pins of the gun mount assembly for testing of the assembly.

20 Claims, 10 Drawing Sheets

ZERO FORCE INSERTION SOCKET FOR GUN MOUNTS

BACKGROUND OF THE INVENTION

1. Field of the Invention

The present invention relates to a zero insertion force socket apparatus for testing gun mount assemblies, methods for making the apparatus and methods for using the apparatus.

More particularly, the present invention relates to a zero force insertion apparatus for testing gun mount assemblies for electrical and optical performance criteria where the apparatus has an opened or disengaged condition for zero force insertion and removal of a mount into a socket associated with the apparatus and a closed or engaged condition for bringing mount pins into electrical communication with electrically conductive receiving elements of the socket so that the gun assembly can be tested for electrical and optical performance while the socket is in the closed condition and where the apparatus can be operated in non-continuous or continuous manner. The present invention also relates to an automated testing apparatus incorporating the socket apparatus, to methods for making the socket apparatus and to methods for using the socket apparatus.

2. Description of the Related Art

Apparatuses are known for testing devices that have sockets such as gun mount assembly for cathode ray tubes or other similar devices. Moreover, various zero insertion force apparatus for testing such devices are also known. Such apparatuses are disclosed in U.S. Pat. No. 5,410,257 to Swaffield and U.S. Pat. No. 5,252,098 to Sano et al., and in several foreign references: Japanese Patent Application No. 6320103, pub. no. 08180810A to Seiichiro, Japanese Patent Application No. 62-241580 to Endou, Japanese Patent Application No. 52-150543 to Shirai and EP98201058.9. However, these apparatuses are not designed to test gun mount assemblies in a zero force insertion manner.

Thus, there is a need in the art for other zero insertion force apparatus for testing gun assemblies either in a non-continuous or continuous manner where the number of moving parts is minimal decreasing breakage and increasing testing efficiency in moving parts is minimal decreasing breakage and increasing testing efficiency in continuous manufacturing facilities.

SUMMARY OF THE INVENTION

The present invention provides a zero insertion force socket apparatus for testing gun assemblies, where the apparatus includes a socket having a plurality of electrically conductive elements incorporated in an electrically insulating body and a movable member associated with the body designed to cause the elements to change from an opened condition to a closed condition.

The present invention provides a zero insertion force socket apparatus for testing gun assemblies, where the apparatus includes a socket having a plurality of deformable, electrically conductive elements incorporated in an electrically insulating body and a movable member associated with the body designed to engage the deformable elements deforming the elements while engaged by the movable member to change the socket from an opened or disengaged condition to a closed or engaged condition. When a gun mount assembly is inserted into the socket and the deformable elements are deformed, the deformation brings the inner wall of each element into electrical contact with a gun mount assembly pin residing therein.

The present invention also provides an assembly line including a plurality of socket apparatus of the present invention, a plurality of gun assembly insertion apparatus and a plurality of engaging members designed to engage the socket movable member so that the gun assembly pins can be brought into and out of electrical contact with conductive elements of the socket apparatus.

The present invention also provides a method for testing a gun mount assembly involving inserting a gun assembly into a socket of a zero force insertion apparatus of the present invention while in its opened or disengaged condition, engaging a movable member of the apparatus causing the socket to change to its closed or engaged condition which brings the pin of the gun assembly into electrical contact with conductive elements in the socket, testing the gun assembly for electrical and optical performance criteria, disengaging the movable member causing the socket to change back to its opened condition and removing the gun assembly. The method of the present invention can be practiced in a continuous or non-continuous mode.

The present invention further provides a method for making the zero insertion force socket assembly of the present invention.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
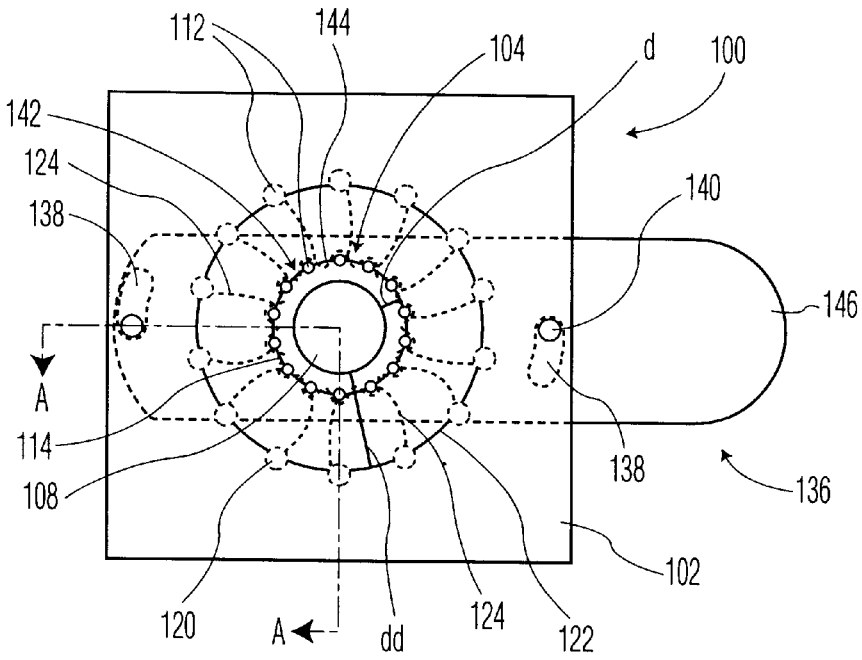
FIG. 1A is a top view of a first preferred embodiment of a zero insertion force socket apparatus of the present invention.

The inventors have found that a socket assembly can be constructed to receive gun mount assemblies in a zero force manner when in an opened condition and thereafter changed to a closed condition for testing the mount according to a set of electrical and optical performance criteria. The inventors have also found that a socket can be constructed with a single moving part having at least two positions; a first position corresponding to the socket in its disengaged or opened, zero force insertion condition and a second position corresponding to the socket in its engaged or closed testing condition which brings the pins of the mount into electrical contact with pin receiving conductive elements of the socket. The socket apparatus can be used to test mount assemblies in either a non-continuous or continuous manner. The inventors have also found that a method using the new zero insertion force sockets of the present invention can be implemented where insertion and removal involves grasping the glass portion of the mount, inserting the pins into the socket, which reduces contamination due to oil and other contaminants typically associated with methods that engage the metal portion of the gun mount assemblies during insertion and removal.

Generally, the moving part will cause the pin receiving conductive elements to undergo a deformation which operates to place the gun pin into electrical communication with the deformed conductive elements when the moving part is forced to change positions from its first position to its second position.

The present invention broadly relates of zero insertion force apparatus for testing gun mount assemblies including a body, a movable member having at least two positions, and a plurality of deformable conductive pin receiving elements where the apparatus is in an opened, zero force insertion condition when the movable member is in a first position and the apparatus is in a closed, pin engaging condition when the movable member is in a second position. The movable member also includes at least one coupling member designed for a user or for a part of an automated assembly line to physically change the apparatus from its disengaged to its engaged position. The coupling member can be one or more protrusion such as an arm, grooves for a pinching device to engage, flattened edges for a wrench type device to engage, or any other similar feature that can couple with a user or another apparatus allowing the insertion apparatus to transition between its disengaged or open position to its engaged or closed position.

The present invention also broadly relates to a method for testing gun mount assemblies including inserting a gun assembly into an apparatus of the present invention while in its zero force insertion condition, engaging a movable member of the apparatus changing the apparatus from a zero force insertion condition into an electrically engaging condition, testing the mount assembly for a set of electrical and optical performance criteria, disengaging the movable member causing the apparatus to change from its electrically engaging condition back to its zero force insertion condition and removing the gun assembly from the apparatus.

The present invention further broadly relates to a method for making the gun mount testing apparatus of the present invention including incorporating a plurality of deformable pin receiving conductive elements in an insulating body, a movable member to engage and disengage the deformable elements changing the elements from a zero force insertion condition to an electrically engaging condition and an equal plurality of conductive elements in electrical communication with the conductive elements.

The body of the apparatus of the present invention is made of non-conductive or insulating materials; while the conductive elements and contacts are made of conductive materials. Suitable insulating materials include, without limitations, non-conductive polymeric materials such as plastics, rubbers, or laminates, or non-conductive ceramics, other non-conductive materials or mixtures or combinations thereof. Plastics rubbers include, without limitations, polymers and copolymers of vinyl and/or diene monomers, polyurethanes, polyamides, polyimides, polycarbonates, polysiloxanes, phenolic resins, mixtures or combination thereof. Polymers and copolymers of vinyl and diene monomers include, without limitation, polyolefins such as polyethylene, polypropylene, polybutylene, acrylics such as polymethylmethacrylate and polymers and copolymers of acrylic acid, methacrylic acid, their esters or acrylonitrile, polyarenes such as polystryene, polyalphamethylstyrene, polydienes such as polybutadiene, polyisoprene or the like, or copolymers of vinyl and diene monomers. When the structural polymers including diene monomers, then the polymers can be crosslinked to improve overall physical properties. Crosslinking can be accomplished chemically (e.g., vulcanization with sulfur cure systems or radical cure systems), thermally, by radiation (e.g., light or irradiation), or mixtures and combinations thereof. Non-conductive ceramics include, without limitation, silicas, silicates (e.g., aluminosilicates, borosilicates, etc.), titanias, titanates, aluminas, aluminates, zirconias, zirconates, other ceramic materials, or mixtures or combination thereof. Additionally, the body can be constructed using mixtures and combination of polymeric and ceramic materials.

Suitable conductive materials include, without limitation, metals, metal alloys, conductive polymers, other conductive materials, or the like, or mixtures or combination thereof. Suitable metals include, without limitation, any conductive metal, but preferably, good conductive metals such as the noble metals (e.g., gold, silver, platinum, palladium, iridium, rhenium, ruthenium and osmium), aluminum, aluminum alloys, copper and copper alloys such as copper beryllium alloys or mixtures or combination thereof. Suitable conductive polymers include, doped polyacetylene, doped polyarylsulfides, metal doped polymers, or the like or mixtures or combination thereof.

Figure 1B:
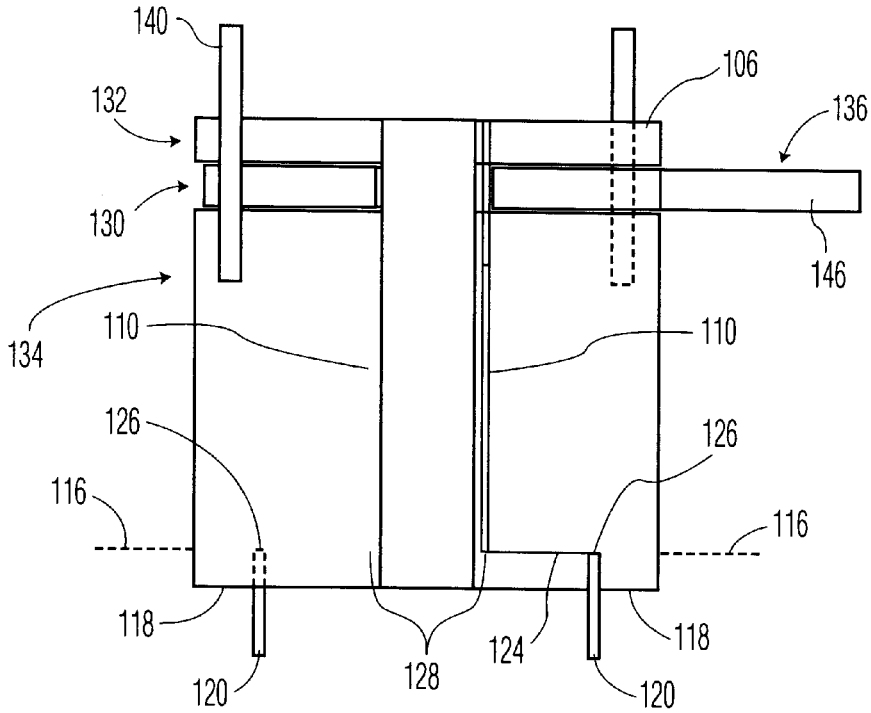
FIG. 1B is a sectional view of the apparatus of FIG. 1A along cutting line A—A.

Referring now to FIGS. 1A–B, a preferred embodiment of the socket apparatus of the present invention generally 100 is shown to include a body 102. The body 102 includes a socket 104 disposed on a top surface 106 of the body 102 and extending into the body 102, where the socket 104 is designed to receive a gun mount assembly. The socket 104 includes a central bore 108 extending through the body 102 and a plurality of electrically conductive, deformable pin holders 110 seated in apertures 112 centered on a first circle 114 concentric with the central bore 108 and separated a distance d from the central bore 108. Each holder 110 extends from the top surface 106 of the body 102 to a plane 116 located near a bottom surface 118 of the body 102 and each holder 110 has an inside diameter greater than a diameter of a pin of a gun mount assembly for zero force insertion and removal.

The apparatus 100 also includes a plurality of electrical contacts 120 protruding below the bottom surface 118 and extending into the body 102 to the plane 116. The contacts 120 are centered on a second circle 122 concentric with the central bore 108 and separated by a distance dd from the central bore 108, where dd is preferably greater than d. The apparatus 100 further includes a plurality of electrical conductors 124 where each conductor 124 electrically connects one electrical contact 120 at its internal end 126 to one holder 110 at its internal end 128.

The apparatus 100 also includes a gap 130 interposed between a upper portion 132 of the body 102 and a lower portion 134 with an engagement member 136 movably fitted within the gap 130. The engagement member 136 includes arcuate slots 138 which engage alignment pins 140, a toothed holder engagement surface 142 including teeth 144 one for each holder 110 and an arm 146 for moving the engagement member 136. The engagement member 136 is designed to move in a rotatory fashion guided by the slots 138 and the pins 140 from a disengaged position to an engaged position. In the disengaged position, the engagement member 136 is aligned so that the holders 110 are in their zero force, undeformed condition. When the holder 110 are in this undeformed condition, a gun mount assembly can be inserted into the socket with substantially zero force. In the engaged position, the engagement member 136 is aligned so that the teeth 144 deform the holders 110 bringing each holder 110 into electrical contact with a gun pin residing therein.

The apparatus 100 is designed to fit or to be plugged into a separate unit that supplies electrical power to the contacts 120 which in turn will supply electrical power to a gun mount assembly through its pins when the engagement member is in its engaged position. Of course, the apparatus 100 can be manually operated or automatically and continuously operated. Manually, a person can insert a gun assembly into the socket with zero force using an apparatus that grasps the mount by its glass portion, engage the pins by rotating the engagement member, test the assembly, disengage the pins by rotating the engagement member in the opposite direction and remove the gun assembly. Continuously, one or more of the apparatus 100 can be mounted in an assembly line which sets the apparatus(es) to their disengaged state, inserts the gun mount assemblies, moves the engagement member to its engaged position, tests the gun, moves the engagement member back to its disengaged position and removes the gun.

The body 102 of the socket apparatus 100 can be made in parts or can be an integral structure. Preferably, the lower portion of the body 102 is injected molded about the holders 110, the contacts 120 and the conductors 124. Alternatively, these elements can be fitted into the body after molding by drilling appropriate apertures and cutting grooves for the conductors and filling the grooves with an insulating bonding agent afterwards. The engagement member can then be positioned on top of the lower portion of the body and the upper portion of the body can be attached to the lower portion or injected onto the lower portion. The alignment pins can the be inserted into the final apparatus. The body can also be made in several different pieces that can be bonded to or held together as illustrated in the second preferred embodiment.

Figure 1C:
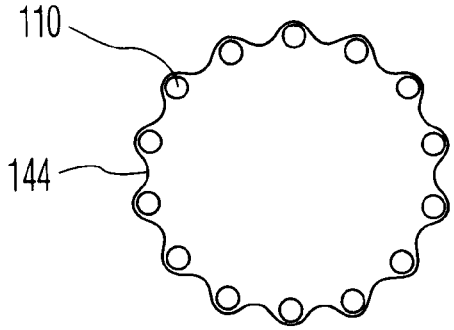
FIG. 1C shows the apparatus of FIG. 1A in disengaged position.
Figure 1D:
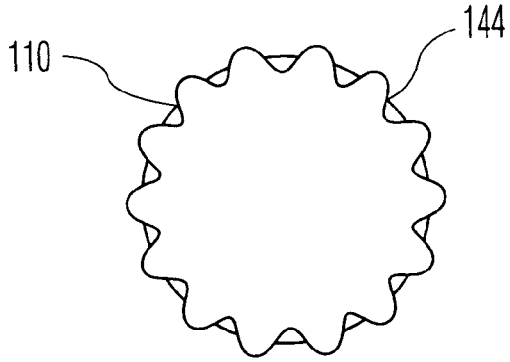
FIG. 1D shows the apparatus of FIG. 1A in engaged position.

Referring now to FIG. 1C, shows the apparatus 100 is its disengaged position where a gun mount assembly can be inserted into the apparatus 100 with substantially zero force where the holders 110 are not deformed. While FIG. 1D shows the apparatus 100 in its engaged position where the teeth 144 have engaged the holders 110 and deformed them depicted by the half moon shapes shown in FIG. 1D.

Figure 2A:
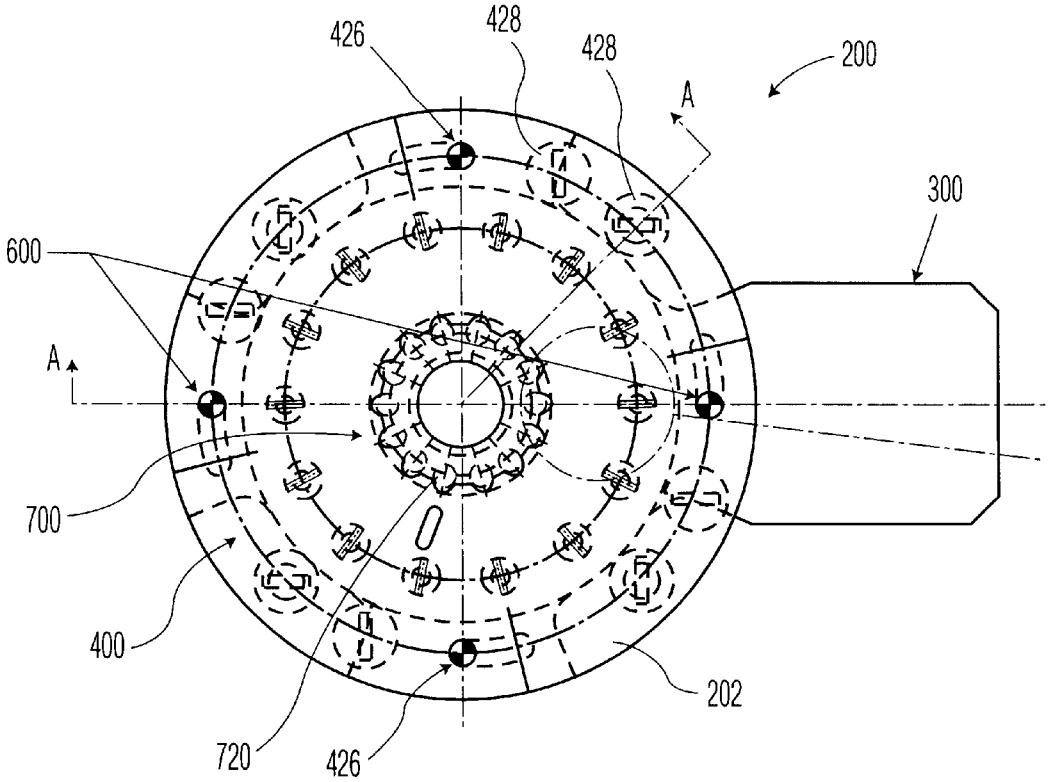
FIG. 2A is a top view of a second preferred embodiment of a zero insertion force socket apparatus of the present invention.
Figure 2B:
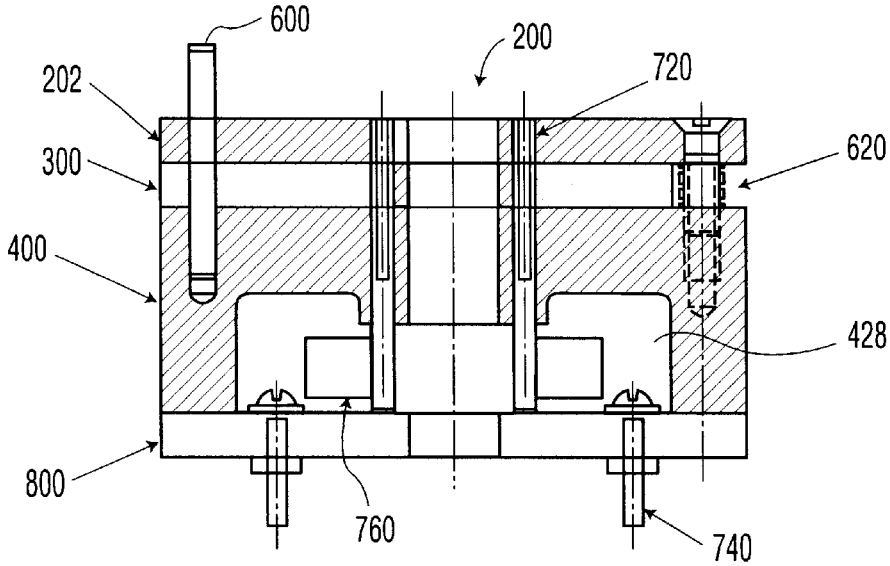
FIG. 2B is a sectional view of the apparatus of FIG. 1A along cutting line A—A.

Referring now to FIGS. 2A–B, another preferred embodiment of the socket apparatus of the present invention generally 200 is shown which includes a top plate 202, a cam plate 300, a main body 400, a bottom plate 500, a plurality of alignment pins 600, and a plurality of stand offs 620. The cam plate 300 is interposed between the top plate 202 and the main body 400 and the stand offs 620 allow the cam plate 300 to move relative to the top plate 202 and the main body 400. The socket apparatus 100 further includes a socket 700 comprising fourteen pin holders 720 inserted into holes in the top plate 202 and main body 400, fourteen associated electrical contacts 740 and fourteen soldering assemblies 760 for placing the pin holders 720 in electrical contact with the electrical contacts 740. The cam plate 300 is designed to assume at least two positions; a first position places the socket 700 in a zero force insertion condition and a second position that deforms the pin holders 720 causing the holders 720 to make electrical contact with the pins of a mount to be tested after the mount has been inserted into socket 700.

Figure 3A:
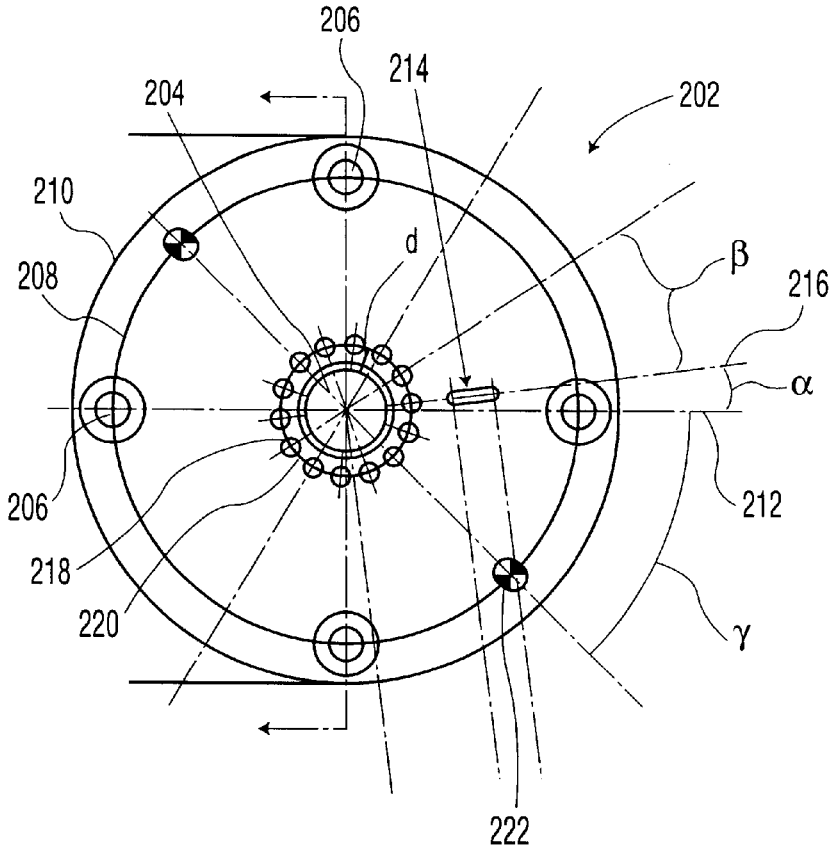
FIG. 3A is a top plan view of a top plate of the apparatus of FIG. 1.
Figure 3B:
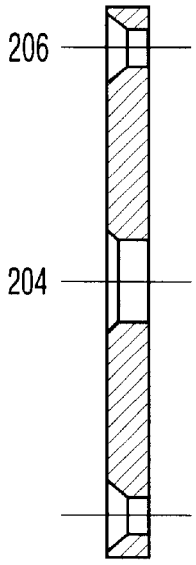
FIG. 3B is a sectional view of the top plate of FIG. 3A along cutting line B—B.

Referring now to FIGS. 3A–B, the top plate 202 is a substantially flat circular plate which includes a central counter-sunk bore 204 and four equally-spaced, counter-sunk apertures 206 centered on a first concentric circle 208 which is located near an outer edge 210 of the plate 202 and where the apertures 206 are separated one from the next by an angle of 90° and are located at 0°, 90°, 180° and 270° with respect to a first axis 212. Of course, the apertures 206 can be non-equally-spaced and separated by an angle less than or greater than 90°. The plate 202 further includes a groove 214 positioned on a second axis 216 which makes an angle $\alpha$ of about 6.5° with respect to the first axis 212. The plate 202 further includes fourteen equally-spaced, pin holder apertures 218 centered on a second concentric circle 220 located the distance d from the center bore 204. Preferably, the apertures 218 are disposed relative to the second axis 216 and separated by an angle $\beta$ of about 25.7° with respect to each other, i.e., 360/14. Obviously, if more or less apertures are used, then the angle between each aperture or hole will change accordingly. The plate 202 also includes two alignment pin apertures 222 centered on the circle 208 and positioned at an angle $\gamma$ of about 45° with respect to the first axis 212 and separated one from the next by an angle of about 180°.

The plate 202 is preferably made of ultra high molecular weight (UHMW) polyethylene; however, any polymeric material that has similar properties can be used. The top plate 202 preferably has a thickness between about 0.1 and about 0.3 inches with a thickness of about 0.15 to about 0.2 being preferred, and a thickness of about 0.16 to about 0.19 being particularly preferred. The central counter-sunk bore 204 has a diameter between about ¼" and about ½" with ⅜" being preferred. The small apertures 218 have a diameter of between about 0.4 and 0.8 " with 0.5 to 0.7 " being preferred and 0.6 " being particularly preferred. Of course, the exact diameter and diameter range will depend to some extent on the gun assemblies to be tested.

Figure 4A:
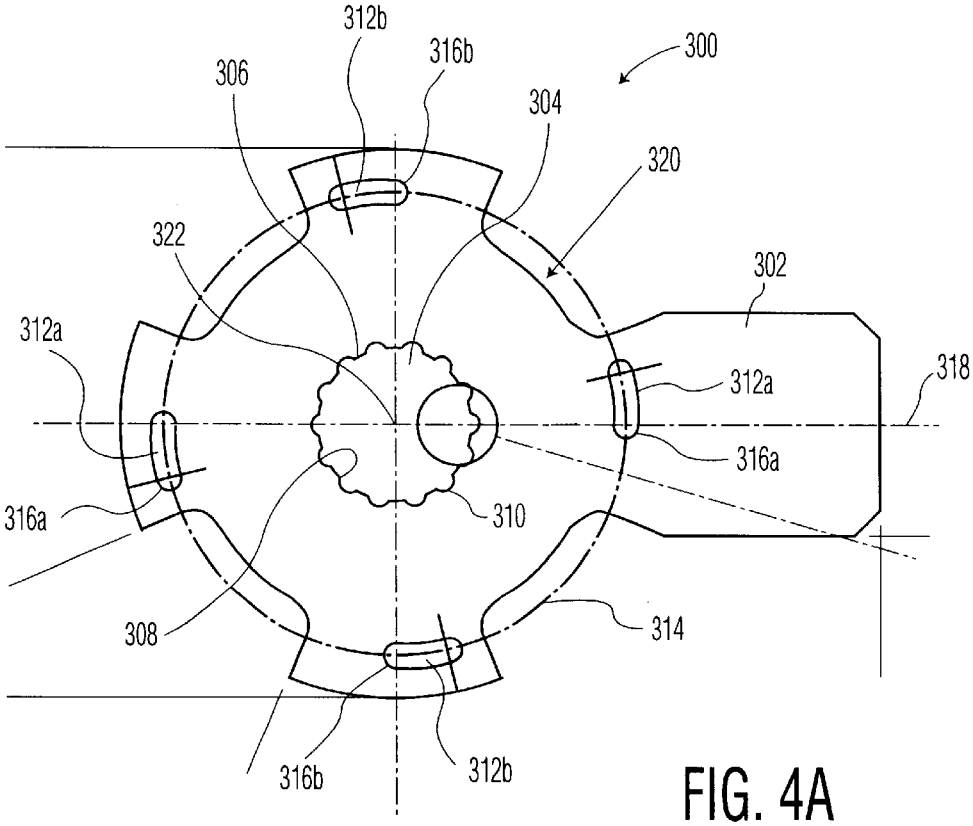
FIG. 4A is a top plan view of one preferred embodiment of a cam plate of the apparatus of FIG. 1.
Figure 4B:
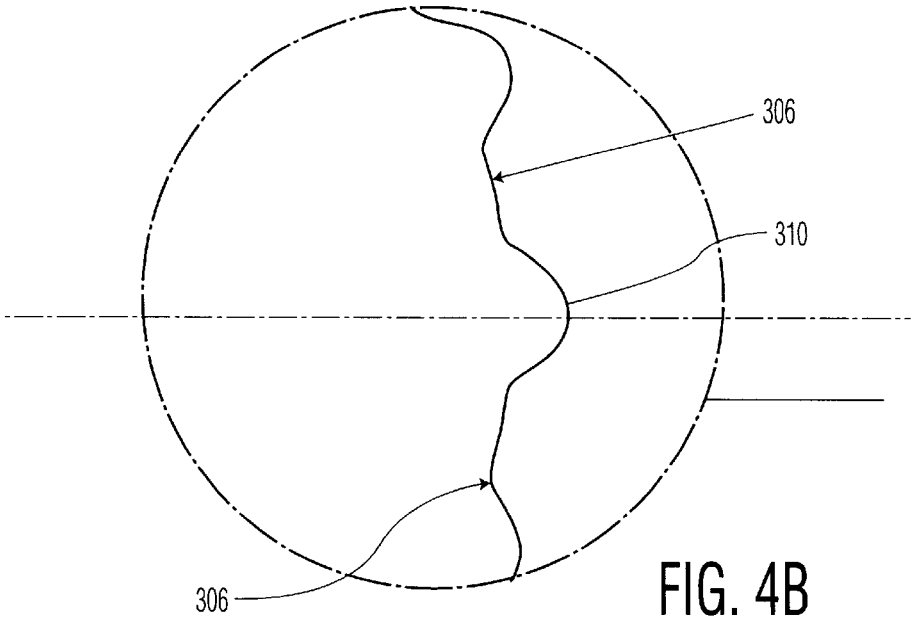
FIG. 4B is an expanded view of teeth associated with the central bore of the cam plate of FIG. 4A.

Referring now to FIGS. 4A–B, the cam plate 300 includes an arm or a lip 302 and a central aperture 304 larger than and aligned with the central bore 204 of the top plate 202. The central aperture 304 includes fourteen equally-spaced teeth 306 forming a toothed engagement surface 308. The teeth 306 extend over an arc length sufficient to deform the holders 720 when the cam member 300 is in its engaged position. Moreover, the teeth 306 are separated by circular grooves 310 designed to accommodate the pin holders 720 in their undeformed condition when the socket 700 is in its zero force insertion condition and the cam member 300 is in its disengaged position.

The cam member 300 further includes four equally-spaced slots 312 centered on a third circle 314 coincident with the first circle 208 of the top plate 200 and where two opposing slots 312*a* are designed to align at their first ends 316*a* with the apertures 222 of the top plate 202 while the other two opposed slots 312*b* are designed to align with their first ends 316*b* with cam pins 426. The first end 316 of each slot 312 is separated by an angle of about 90° from the next end 316 and the first ends are centered at 0°, 90°, 180° and 270° relative to a third axis 318 which makes an angle of 45° with the first axis 212 of the top plate 202. The cam member 300 also includes four cutaways 320 designed to allow the cam plate 300 to undergo its full range of motion without contacting any other structure of the apparatus 200.

The cam plate 300 is designed to rotate about a central axis 322 which transitions the apparatus 200 from its disengaged position or configuration to its engaged position or configuration by deforming the pin holders 720 so that the pin holders 720 come into electrical contact with the pins of a gun assembly to be tested that has previously been inserted into the socket 700. Correspondingly, the rotation of the cam plate 300 changes the socket 700 of the apparatus 200 from an opened condition for zero force gun assembly insertion or removal of the gun assembly to a closed condition for placing the pins of the gun assembly into electrical contact with the pin holders 720 of the socket 700.

Figure 4C:
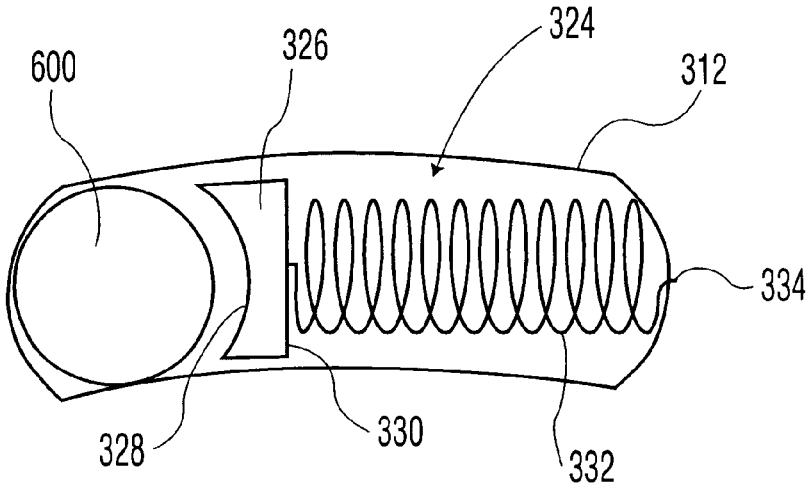
FIG. 4C shows a first variation of the cam plate of FIG. 4A.

The cam plate 300 can also include at least one bias member 324 that acts to return the cam plate 300 to its first or disengaged position as shown in FIG. 4C. In FIG. 4C, a bias member 324 is affixed within at least one slot 312 of the cam plate 300. The bias member 324 comprises a disk 326 having a concave end 328 designed to engage one of the alignment pins 600 or cam pins 426, a flat end 330 and a spring 332 interposed between the flat end 330 of the disk 326 and a second end 334 of each slot 312. The spring 332 is designed to return the cam plate 300 to its disengaged position after a rotational force acting on the arm 302 is discontinued. Although only a single slot is described as having a bias member, any number of the slots can include a bias member so that the bias members can act in tandem. It should be recognized that any apparatus that acts in a manner similar to a coiled spring can be interposed between the disk and the end of the slot.

The cam plate 300 is preferably made of TORLON 4203, but any other structural, non-conductive polymeric or ceramic material can be used as well.

Figure 4D:
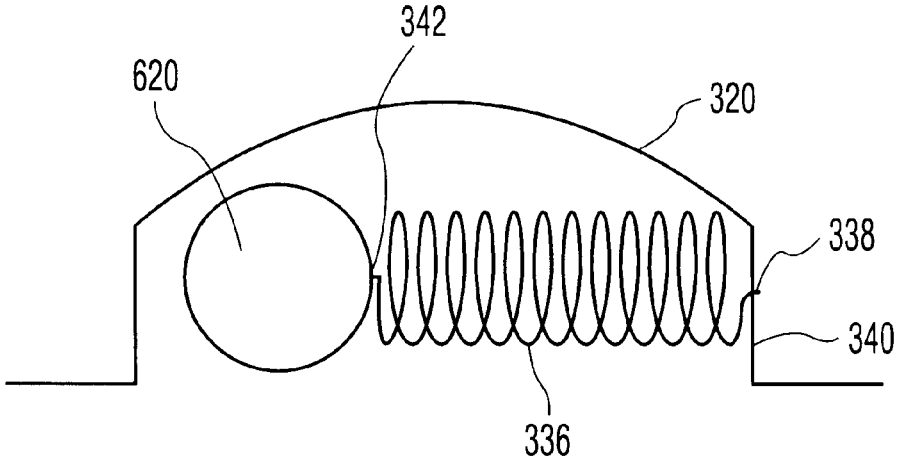
FIG. 4D shows a second variation of the cam plate of FIG. 4A.

Alternatively, as shown in FIG. 4D, the cam plate 300 can include at least one spring 336 having one end 338 affixed to a first wall 340 of at least one cutaway 320 and a second end 342 affixed to a corresponding stand off 620 so that the cam plate 300 will automatically return to its disengaged position when an engaging force acting on the arm 302 is discontinued. It should be recognized to an ordinary artisan that other bias member configurations can be used as well as is well known in the art; provided, however, that the bias member acts to automatically return the apparatus 200 to its disengaged position whenever no force is acting on the arm 302. Obviously, the bias member can be configured not to return the apparatus 200 to its disengaged position, but to its engaged position.

The bias member can be made of any suitable material including, without imitation, metals, ceramics, polymers, mixtures or combinations thereof.

Figure 5A:
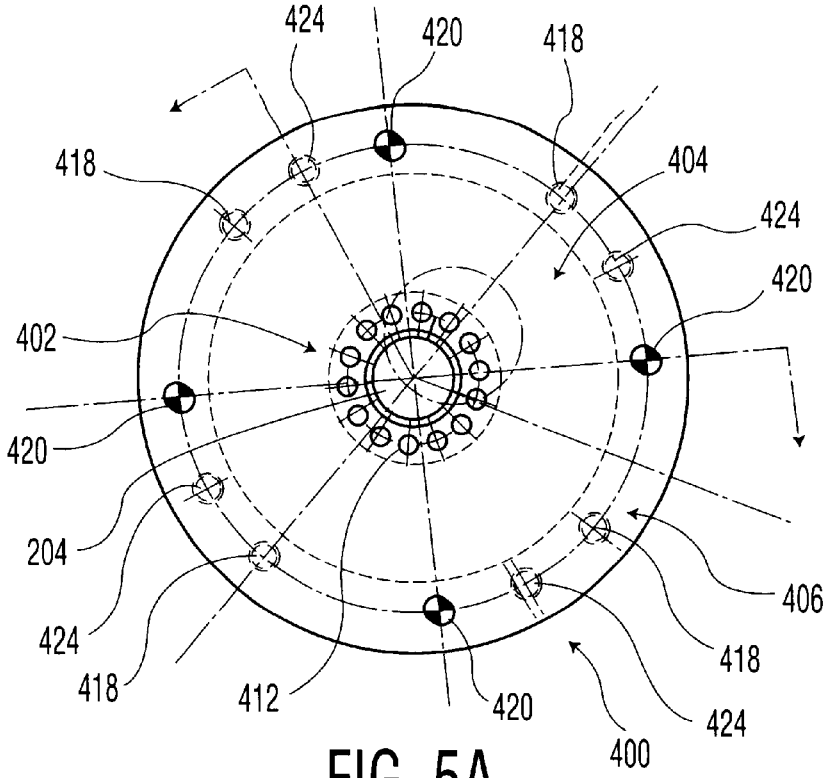
FIG. 5A is a top plan view of a main body of the apparatus of FIG. 1.
Figure 5B:
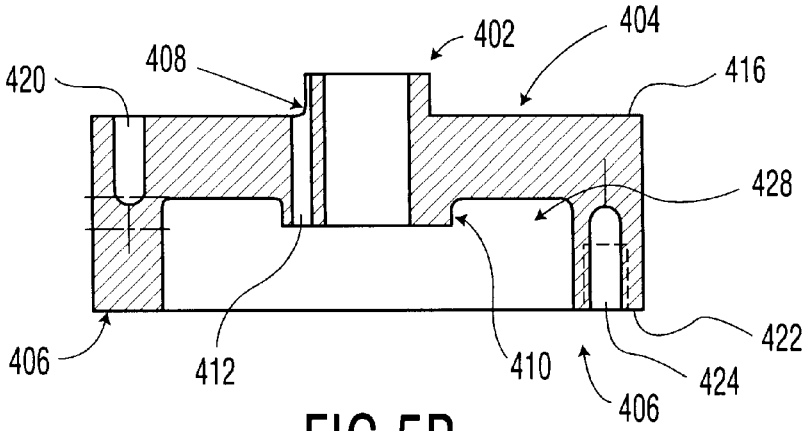
FIG. 5B is a sectional view of the main body of FIG. 5A along cutting line C—C.
Figure 5C:
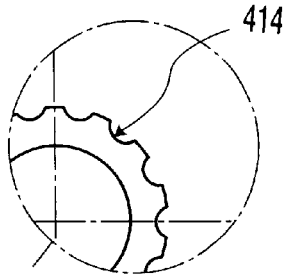
FIG. 5C is an expanded view of the main body of FIG. 5A along cutting circle C.

Referring now to FIGS. 5A–C, the generally circular main body 400 includes a central region 402 through which the central bore 204 passes, a radial web region 404 extending from the central region 402 to a cylindrical margin region 406. The central region 402 includes a raised top portion 408 extending above the web region 404 and a raised bottom portion 410 extending below the web region 404. Surrounding the central bore 204 in the main body 400 are fourteen equally-spaced, pin holder apertures 412 coincident with the apertures 218 as shown in FIG. 3A so that when properly aligned the holders 720 can be inserted through both apertures 218 and 412. The apertures 412 cause the raised top portion 408 to have a gear-like shape 414. The gear-like shape 414 includes fourteen arcuate portions 413 separated by fourteen flatter portions 415. The arcuate portions 413 form the surfaces against which the holder 720 deform when engaged by the cam engagement member 308. During assembly of apparatus 200, the cam engagement surface 308 fits onto the raised top portion 408 so that the holders 720 align with the grooves 310 of the toothed engagement surface 308 of the cam member 300. Thus, when the cam member 300 is rotated from its first or disengaged position where the teeth 306 of the cam plate 300 are not in contact with the holders 720, the teeth 306 engage the holders 720 deforming the holders 720 and bringing the holders 720 into electrical contact with the pins of a gun assembly inserted into the socket 700.

Associated with a top surface 416 of the margin region 406 are four equally-spaced, first partial top bores 418 coincident with the apertures 206 of the top plate 202.

Also associated with the top surface 416 of the margin region 404 are four equally-spaced, second partial top bores 420 separated by 90° and offset by an angle of 45° relative to the first partial top bores 418. Associated with a bottom surface 422 of the margin region 404 are four equally-spaced partial bottom bores 424 separated by 90° and positioned at an angle of 22.5° relative to the first partial top bores 418.

Two opposed partial bores 420 coincide with the two alignment pin apertures 222 of the top plate 202 and are designed to receive the alignment pins 600; while the other two opposed partial bores 420 are designed to have cam pins 426 inserted therein which extend into two corresponding slots 312 of the cam plate 300 as shown in FIG. 1A. The cam pins 426 and the alignment pins 600 allow the cam plate 300 to travel in a circular path as dictated by the slots 312 in the cam plate 300, i. e., the alignment pins and the cam pins act as guides for the cam plate as it undergoes rotation from its disengaged position to its engaged position and back again. The margin region 406 of the main body 400 and the web region 404 result in the formation of an open gap 428 in the apparatus 200. The main body is preferably made of acrylic, but any other rigid non-conductive, polymeric material can be used as well.

Figure 6A:
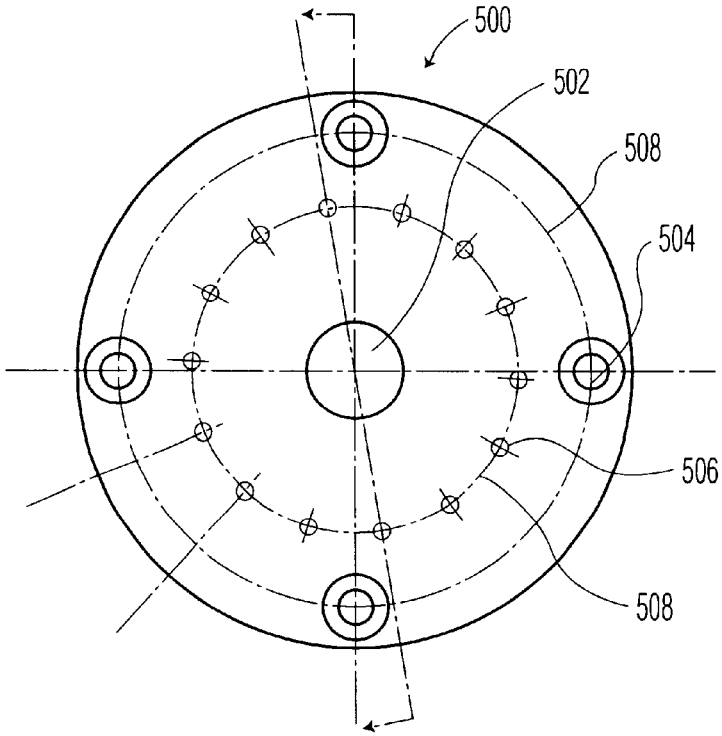
FIG. 6A is a top plan view of a bottom plate of the socket of FIG. 1.
Figure 6B:
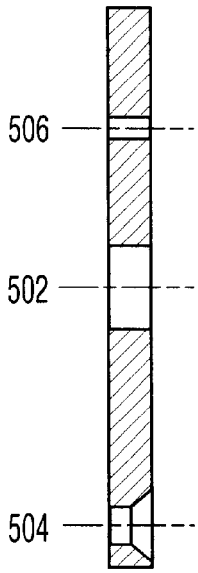
FIG. 6B is a section view of the bottom plate of FIG. 6A along cutting line D—D.

Referring now to FIGS. 6A–B, the bottom plate 500 includes a central bore 502 and four equally-spaced, counter-sunk apertures 504 coincident with the partial bottom bores 424 of the main body 400. The bottom plate 500 also includes fourteen equally-spaced, electric contact apertures 506 centered on a circle 508 and separated one from the other by an angle of about 25.7° (360/14° degrees) and corresponding in number with the pin holder apertures 218 and 412 and designed to receive the electrical contacts 760. The first partial top bores 418 and the counter-sunk apertures 206 as well as the bottom partial bores 424 and the counter-sunk apertures 506 are designed to receive screws 510 as shown in FIG. 1A. The preferred structural material used to make the bottom plate is ultra high molecular weight polyethylene, but any other non-conductive materials can be used as well.

Figure 7:
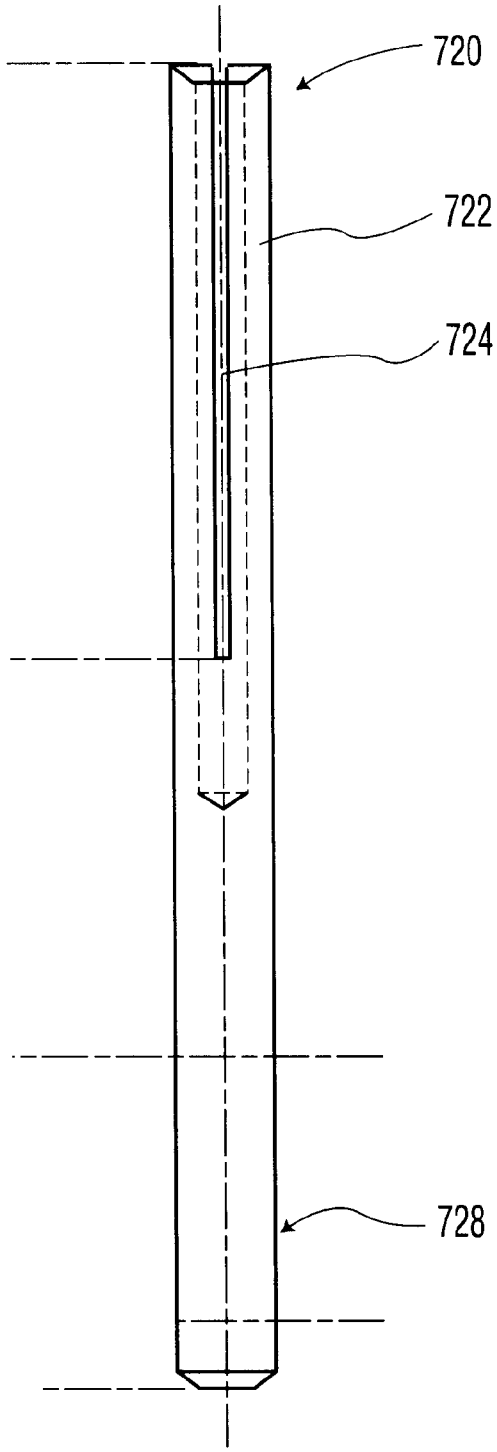
FIG. 7 is a side view of a pin holder of the apparatus of FIG. 1.

Referring now to FIG. 7, each pin holder 720 comprises a tube 722 having at least one vertical slot 724 in a top portion 726 thereof and where the tubes 722 have a diameter sufficient for the tubes to be inserted through apertures 218 in the top plate 202 and the corresponding apertures 412 in the main body 400. The top portion 726 of the tubes 722 are positioned in the raised top portion 408 of the main body 400 so that when the cam plate 300 is rotated to its engaged position, the teeth 306 engage the tubes 722 causing the tubes 722 to be squeezed due to the presence to the vertical slots 724 in each tube 722. The preferred material for the holders is a beryllium copper alloy, but other similar conductive material can be used as well.

Alternatively, the tubes can have two vertical slots arranged at some angle relative to each other such as a 90° angle. Of course, if the tubes are made of a resilient conductive material such as metal doped elastomers, then when the teeth 306 of the cam plate 300 engage the tubes 722, the compression will not only bring the elastomeric material into contact with a gun mount pin therein, but will also cause the elastomeric material to become conductive.

Figure 8:
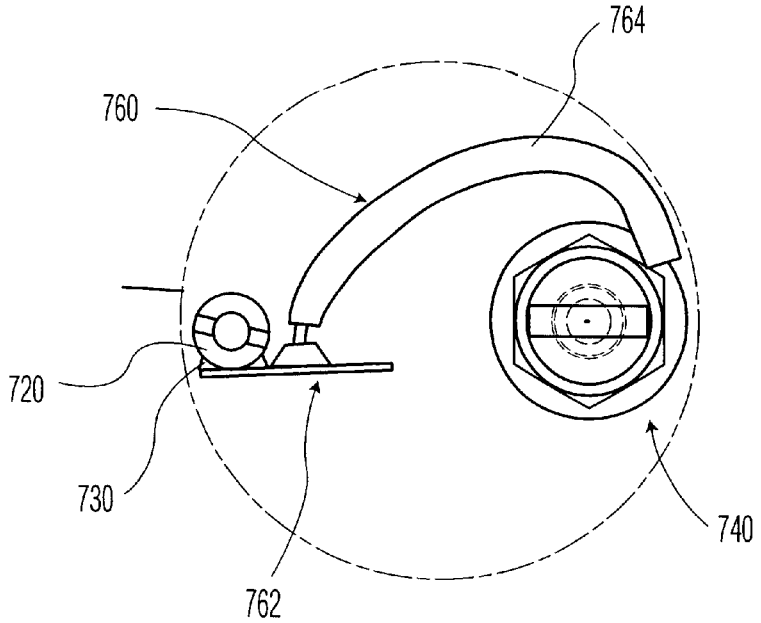
FIG. 8 is a top view of one preferred embodiment of a solder assembly of the apparatus of FIG. 1.

Referring now to FIG. 8, each solder assembly 760 includes a strip 762 soldered to each pin holder 720 at its distal end 728 by solder 730 where the distal ends 728 of the holders 720 extend into the gap 428 and each strip 762 is positioned within the gap 428. Onto each strip 762 is soldered a wire 764 extending from each strip 762 to each electrical contact 740. It should be recognized to an ordinary artisan that other construction can be used; provided, however, that each pin holder 720 is in electrical communication with its corresponding electrical contact 740. The preferred material for the strip is phosphor bronze, but other similar conductive material can be used as well.

Figure 9A:
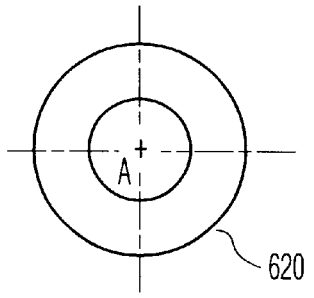
FIG. 9A is a top view of a stand off of the apparatus of FIG. 1.
Figure 9B:
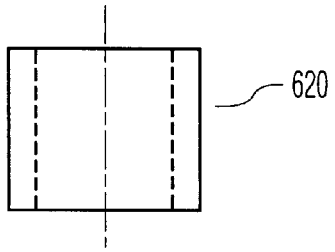
FIG. 9B is a side view of the stand off of FIG. 9A.

Referring now to FIGS. 2 and 9A–B, each stand off 620 is a cylindrical tube having a height equal to or slightly greater than the thickness of the cam plate 300. Preferably, the stand offs 620 has a height slightly greater than the thickness of the cam plate 300 so that the cam plate can freely move from its disengaged position to its engaged position. The stand offs are preferably composed of stainless steel, but any other structural material can be used as well such as ceramics.

Although the invention has been disclosed with reference to its preferred embodiments, from reading this description those of skill in the art may appreciate changes and modification that may be made which do not depart from the scope and spirit of the invention as described above and claimed hereafter.

We claim:

1. A zero insertion force socket apparatus for testing gun assemblies comprising:

a body including:

a socket comprising:

a central bore extending through the body;

a plurality of apertures surrounding the bore and extending into the body, each aperture having seated therein an electrically conductive, deformable pin holder;

a plurality of electrical contacts in electrical communication with the holders and surrounding the central bore, each contact having an exposed portion for receiving electrical power;

a gap interposed between a top portion and a bottom portion of the body; and an engagement member designed to moveably fit in the gap, the member comprising:

at least one coupling member designed to move the engagement member between a disengaged or zero force insertion/removal state and an engaged or gun testing state; and an engagement surface designed to deform the holder when the engagement member is in the engaged state and leave the holder undeformed when the engagement member is in the disengaged state.

2. The apparatus of claim 1, further comprising:

a plurality of conductors electrically connecting a contact to a corresponding holder.

3. The apparatus of claim 1, wherein the engagement surface includes teeth and grooves, one tooth and one groove for each holder where the teeth are designed to engage and deform the holders when the engagement member is in the engaged state.

4. The apparatus of claim 1, wherein the exposed portion of the contacts extend below a bottom surface of the body.

5. The apparatus of claim 1, wherein an internal diameter of each holder is greater than a diameter of a pin of a gun assembly for zero force insertion into and removal from the socket.

6. The apparatus of claim 1, wherein the coupling member is an arm.

7. The apparatus of claim 1, wherein coupling member comprises two vertical grooves for engaging a pincher apparatus which is designed to rotate the coupling member changing the engagement member from its disengaged to its engaged state.

8. The apparatus of claim 1, wherein the pin holders comprise tubes having at least one vertical slot therein extending down a portion of a length of the tubes.

9. The apparatus of claim 1, wherein the pin holders comprising tubes made of a metal doped elastomeric material.

10. A zero insertion force socket apparatus for testing gun assemblies comprising:

a body including:

a central region having:

a raised top portion, a body central bore and a plurality of body apertures surrounding the central bore and forming a gear-like outer surface of the top portion, a radial web, and a cylindrical margin;

a top plate designed to attach to the raised top portion of the central region of the body, the top plate including:

a central bore coincide with the body central bore and a plurality of top plate apertures surrounding the central bore and coincide with the body apertures;

a bottom plate designed to attach to a bottom surface of the cylindrical margin of the body, the bottom plate including:

a bottom central bore coincide with the body and top central bores, a plurality of bottom plate apertures surrounding the central bore; a cam plate interposed between the body and the top plate and designed to mover relative to the top plate and the body, the cam plate including:

a coupling member and a central aperture having an engagement surface so that the central aperture fits over the raised top portion of the central region of the body;

a plurality of electrically conductive, deformable pin holders inserted into the coinciding top and body apertures, each holder having an exposed portion associated with the raised top portion of the body; and a plurality of electrical contact inserted into the bottom plate apertures, the contacts including an exposed end for receiving electrical power and an internal end in electric contact with the holders, and where the coupling member allows the cam plate to be moved from a disengaged state for zero force insertion and removal into the holder and an engaged state designed to deform the exposed portion of the holders so that the holder comes into electrical contact with an inserted gun mount assembly pin.

11. The apparatus of claim 10, wherein the top plate further includes attachment apertures position near its outer edge, the body includes coinciding top partial bores in its top surface, the cam plate includes cutaways where the attachment apertures and the partial bores are designed to receive vertical attachment members and the cutaways allow the cam plate to change from its disengaged position to its engaged position without contacting the members.

12. The apparatus of claim 1, wherein the bottom plate further includes attachment apertures position near its outer edge, the body includes coinciding bottom partial bores in its bottom surface where the attachment apertures and the partial bores are designed to receive vertical attachment members.

13. The apparatus of claim 11, further comprising spacers positioned between the body and the top plate where the top attachment members pass therethrough.

14. The apparatus of claim 10, wherein the pin holders comprise tubes having at least one vertical slot therein extending down a portion of a length of the tubes.

15. The apparatus of claim 10, wherein the pin holders comprising tubes made of a metal doped elastomeric material.

16. A method comprising the steps of:

aligning a gun mount assembly with a socket apparatus comprising:

a body including:

a socket comprising:

a central bore extending through the body;

a plurality of apertures surrounding the bore and extending into the body, each aperture having seated therein an electrically conductive, deformable pin holder;

a plurality of electrical contacts in electrical communication with the holders and surrounding the central bore, each contact having an exposed portion for receiving electrical power;

a gap interposed between a top portion and a bottom portion of the body; and an engagement member designed to moveably fit in the gap, the member comprising:

at least one coupling member designed to move the engagement member between a disengaged or zero force insertion/removal state and an engaged or gun testing state; and an engagement surface designed to deform the holder when the engagement member is in the engaged state and leave the holder undeformed when the engagement member is in the disengaged state positioning the engagement member to its engaged state which places the holders into electrical contact with the pins of the gun mount assembly;

testing the gun mount assembly by applying electric power to the gun mount assembly via the contacts;

repositioning the engagement member to its disengaged state which breaks the electrical contact between the pin holders and the pins; and removing the gun mount assembly.

17. The method of claim 16, wherein the method is continuous.

18. The method of claim 16, wherein the pin holders comprising tubes having at least one vertical slot extending a portion of the length of the tube.

19. The method of claim 16, wherein the exposed end of the contact extends below a bottom surface of the bottom plat.

20. The method of claim 18, where in the tube is a beryllium copper alloy and the tubes and the contacts are placed in electrical contact via a plate soldered to each tube and a wire soldered to the plate at one end and attached at its other end to an internal end of the contact.

* * * * *